United States Patent [19]

Feucht et al.

[11] 4,322,092

[45] Mar. 30, 1982

[54] CROSS COUNTRY SKI BINDING

[75] Inventors: Rudi Feucht, Weissach; Manfred Schmidt, Sindelfingen; Peter Biermann, Leonberg, all of Fed. Rep. of Germany

[73] Assignee: Vereinigte Baubeschlagfabriken Gretsch & Co., Ltd., Leonberg, Fed. Rep. of Germany

[21] Appl. No.: 123,051

[22] Filed: Feb. 20, 1980

[30] Foreign Application Priority Data

Feb. 20, 1979 [DE] Fed. Rep. of Germany ..... 2906485

[51] Int. Cl.[3] ..... A63C 9/20

[52] U.S. Cl. ..... 280/615

[58] Field of Search ..... 280/615, 614, 611, 613; 36/117, 125

[56] References Cited

U.S. PATENT DOCUMENTS

| | | | |
|---|---|---|---|
| 4,082,312 | 4/1978 | Johnson | 280/615 |
| 4,108,467 | 8/1978 | Kreyonbuhl | 280/615 |
| 4,219,215 | 8/1980 | Bierman et al. | 280/615 |
| 4,235,452 | 11/1980 | Linecker | 280/615 |

FOREIGN PATENT DOCUMENTS

| | | | |
|---|---|---|---|
| 2622966 | 4/1977 | Fed. Rep. of Germany | 280/615 |
| 2643223 | 4/1978 | Fed. Rep. of Germany | 280/615 |
| 2653782 | 6/1978 | Fed. Rep. of Germany | 280/615 |
| 2815167 | 10/1978 | Fed. Rep. of Germany | 280/615 |
| 2735489 | 2/1979 | Fed. Rep. of Germany | 280/615 |
| 2290925 | 6/1976 | France | 280/615 |
| 673948 | 11/1964 | Italy | 280/636 |

*Primary Examiner*—David M. Mitchell

*Attorney, Agent, or Firm*—Craig and Antonelli

[57] ABSTRACT

A cross country ski binding for securing a ski shoe by a forwardly directed extension of its sole to a ski features a recess defined between two side walls, a top wall and a base plate with at least one and preferably two bracing members arranged within the recess and extending vertically at right angles to the top wall of the recess. The bracing members are adapted in operation to engage in corresponding longitudinally extending slots in the sole extension and serve to stiffen the recess and to react the tilting moments occuring during skiing. A securing device in the form of a toggle lever mechanism includes a hooked member which serves to engage behind a corresponding projection on the sole extension to draw the same into the binding and to prevent the ski shoe from moving rearwardly out of the binding.

Various modifications are disclosed including an embodiment in which the bracing members are formed by inwardly turned portions of the sheet metal base plate of the binding.

22 Claims, 5 Drawing Figures

CROSS COUNTRY SKI BINDING

Figure 1:
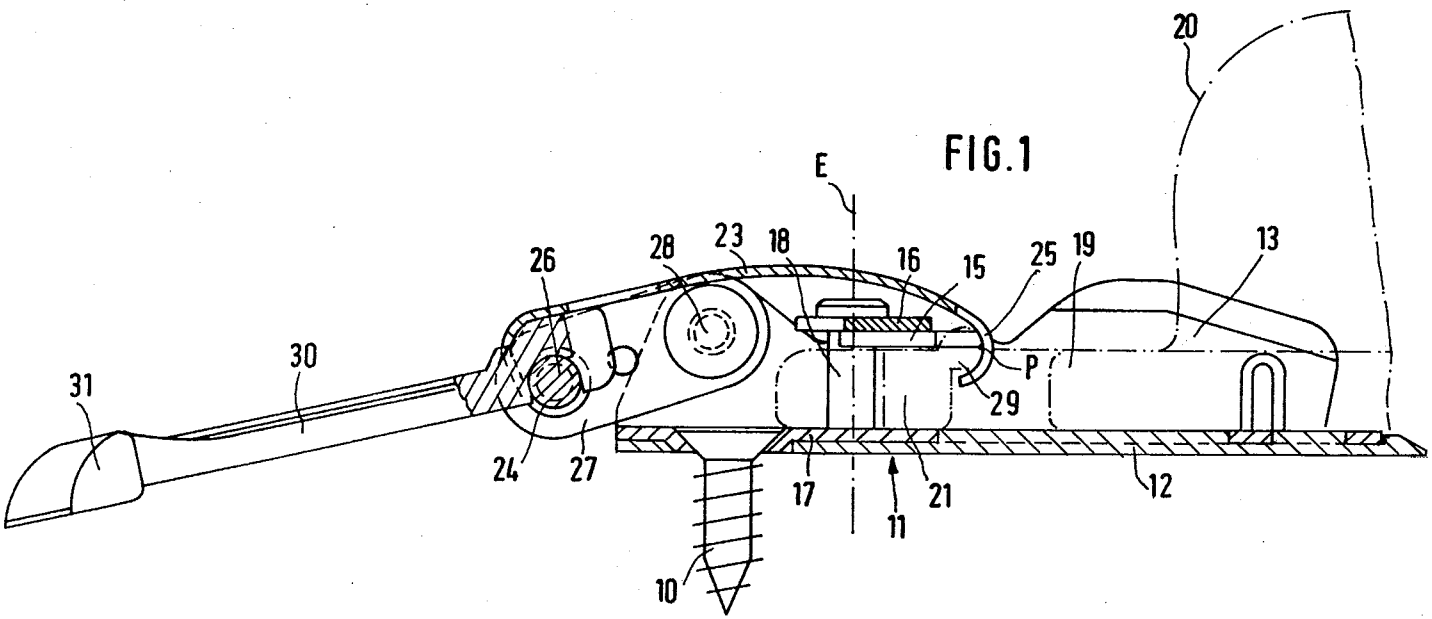

The invention relates to a cross country ski binding and has particular reference to a cross country ski binding for securing a ski shoe by a forwardly directed extension of its sole to a ski.

Ski bindings of this general kind are known in which the sole extension engages a binding part which provides support at its sides, its front end and from above and in which the sole extension is located by a securing device arranged to prevent the extension from being withdrawn rearwardly from the binding.

A sole extension of this kind exhibits the tendency, despite being clamped into the binding to yield to a greater or lesser degree to pronounced torsional loads which try to turn the sole of the ski shoe about an axis at right angles to the ski and also about an axis extending in the longitudinal direction of the ski. This tendency becomes more pronounced as the sole extension is made narrower.

In order to produce a more secure connection between the forward end of the sole of the ski shoe and the ski by a binding part which is fixed relative to the ski, it is known to provide pins arranged at right angles to the ski on the ski or on a part of the binding and to arrange for the sole of a ski shoe to have correspondingly arranged bores or recesses to engage on these pins. The sole of the ski shoe must in this case be placed over the pins from above. This arrangement requires, however, the sole of the ski shoe to be manoeuvred in a manner which is not always entirely straightforward. In addition the stability required to prevent lifting of the front end of the sole of the ski shoe from the ski is not always ensured by the securing device which clamps onto the sole of the ski shoe from above.

A thongless binding of the above kind is known from German Gebrauchsmuster No. 15 19 946 in which a forwardly disposed plate, which is fixedly connected with the sole of a ski shoe, has two bores which can be placed on two pins of a forward part of the binding and is secured against lifting away from the ski by means of a locking lever which is rotatable against spring pressure. The coupling of the plate which is arranged on the sole of a ski shoe with the two pins is complicated and uncomfortable for the skier because the shoe must be lifted and the locking lever simultaneously pivoted sideways. In addition the loads which occur on the pin connection become very large when large side forces occur during skiing and the latching of the latching lever against upward movement is deficient.

A further binding of this same general kind is known from German Offenlegungsschrift No. DE-OS No. 27 14 990 which likewise has pins arranged at right angles to and fastened to the ski. In this arrangement bores which are provided in the forward end of the sole of the ski shoe which projects beyond the cap of the ski shoe can once more be engaged on the pins. When the ski shoe is engaged in the binding the forward end of the sole of the ski shoe is held between two forwardly converging side cheeks and is secured from above by a wire hoop which, on tensioning the binding by means of an over centre tensioning leaver engages behind rearwardly directed hook-like projections on the side cheeks. The sole of the ski shoe can once more only be introduced into the binding from above so that the bores in the sole of the ski shoe can be engaged with the vertically directed pins.

An alternative form of cross country ski binding is known from German Auslegeschrift DE-AS No. 26 22 966 in which the forward end of the sole of the ski shoe which projects beyond the cap of the ski shoe has two longitudinal recesses which are crossed through by an axle extending transversely to the longitudinal direction of the ski and embedded in the sole. A spring biased clamp which is arranged in front of the sole of the ski shoe and is provided with hook-like ends can be engaged on the axle from above. The axle thus forms a pivot axle about which the ski shoe can rotate on lifting of the heel from the ski and the clamp lever which engages with the axle must carry both the sideways forces and also the upwardly directed forces which try to lift the forward part of the sole of the ski shoe from the ski. A clamp of this kind is, however, inadequate and the coupling of the forward end of the sole of the ski shoe with the clamp lever requires a certain degree of dexterity.

The principal object underlying the present invention is to provide a ski binding of simple construction which enables the binding to be engaged in simple manner and which also achieves an acceptable support of the ski shoe in the binding so that a stable connection is ensured between the sole extension and the ski, which is resistant to sideways and torsional forces and which is in particular such that the securing device which clamps the ski shoe into the binding is not required to carry sideways or vertical forces. To accomplish this object there is provided, in accordance with the present invention, a cross country ski binding for securing a ski shoe by a forwardly directed extension of its sole to a ski the binding comprising a recess open at its rear end and defined by at least first and second side walls and a top wall for supporting a said sole extension introduced through the rear end of the recess there being at least one bracing member arranged within the recess and extending substantially at right angles to said top wall, said bracing member being adapted in operation to engage in a corresponding longitudinally extending, slot in said sole extension, which slot is open at its forward end, and a securing device engageable with a ski shoe engaged in the binding to prevent it being withdrawn rearwardly from the binding.

A binding of this kind has the advantage that the sole extension is secured in absolutely reliable manner against sideways and tilting forces. This support is achieved by virtue of the one or more bracing members which engage in the slots and which, particularly in conjunction with the wall parts of the binding and also in conjunction with the securing device which prevents withdrawal of the sole extension in the rearward direction, carry the loads which occur due to torsional or tilting moments by rigid engagement with the slots of the sole extension and thus counteract the tendency of the sole extension to tilt under the influence of these forces. The securing or tensioning device can thus be partially or wholly relieved of the task of securing the sole extension from above and is solely required to secure the sole projection in the binding against withdrawal rearwardly in the longitudinal direction of the ski or to bias the sole extension forwardly by drawing it into the binding.

Furthermore, the invention enables the skier to engage the binding in simple fashion because he merely requires to push the ski shoe with the sole extension into the binding from the rear. The binding can readily be constructed so that the longitudinal slots of the sole extension and the bracing member or members automatically connect one with the other. The skier then merely requires to apply the securing or clamping device by hand, or by means of a ski pole in order to clamp the sole extension in the binding to prevent it from being withdrawn rearwardly in the longitudinal direction of the ski.

In advantageous modifications of the basic arrangement of the invention the binding conveniently includes a base wall which can form part of a base plate of the binding and which cooperates with the first and second side walls and the top wall to define the aforementioned recess. The first and second side walls and the top wall and base wall can conveniently be united to form a housing with the interior of the housing defining the recess.

It is particularly advantageous if the first and second bracing members are respectively disposed one to each side of the central longitudinal axis of the binding and are adapted to engage in operation in respective first and second slots in the mating sole extension. The torsional moments which are applied to the ski shoe can then be carried solely by the bracing moment which is generated by the bracing members. If necessary, this bracing moment can be assisted by the restraint provided by the side walls of the binding.

It is sufficient if the, or each of the, bracing members are merely constructed as upwardly directed projections; however, an arrangement is preferred in which the bracing elements are constructed as webs or pins which physically connect the base and top walls defining the recess.

The particularly preferred embodiment features a binding which includes a base plate and has first and second bracing members which connect the base plate to respective inwardly directed first and second extensions of the first and second side walls with the first and second extensions defining respective first and second parts of the top wall. In arrangements of this kind it can be ensured that the side walls are not deflected, even under very pronounced sideways or torsional forces, and that the support of the toe extension in the binding or recess is additionally secured.

The bracing elements can be of circular or other cross section, for example elongate cross section, so that they engage the walls of the slots over a large surface area which is particularly advantageous for carrying the sideways forces.

Further features of the invention are concerned with a particularly advantageous construction and arrangement of the securing device in combination with the support of the sole extension in the binding recess.

Figure 2:
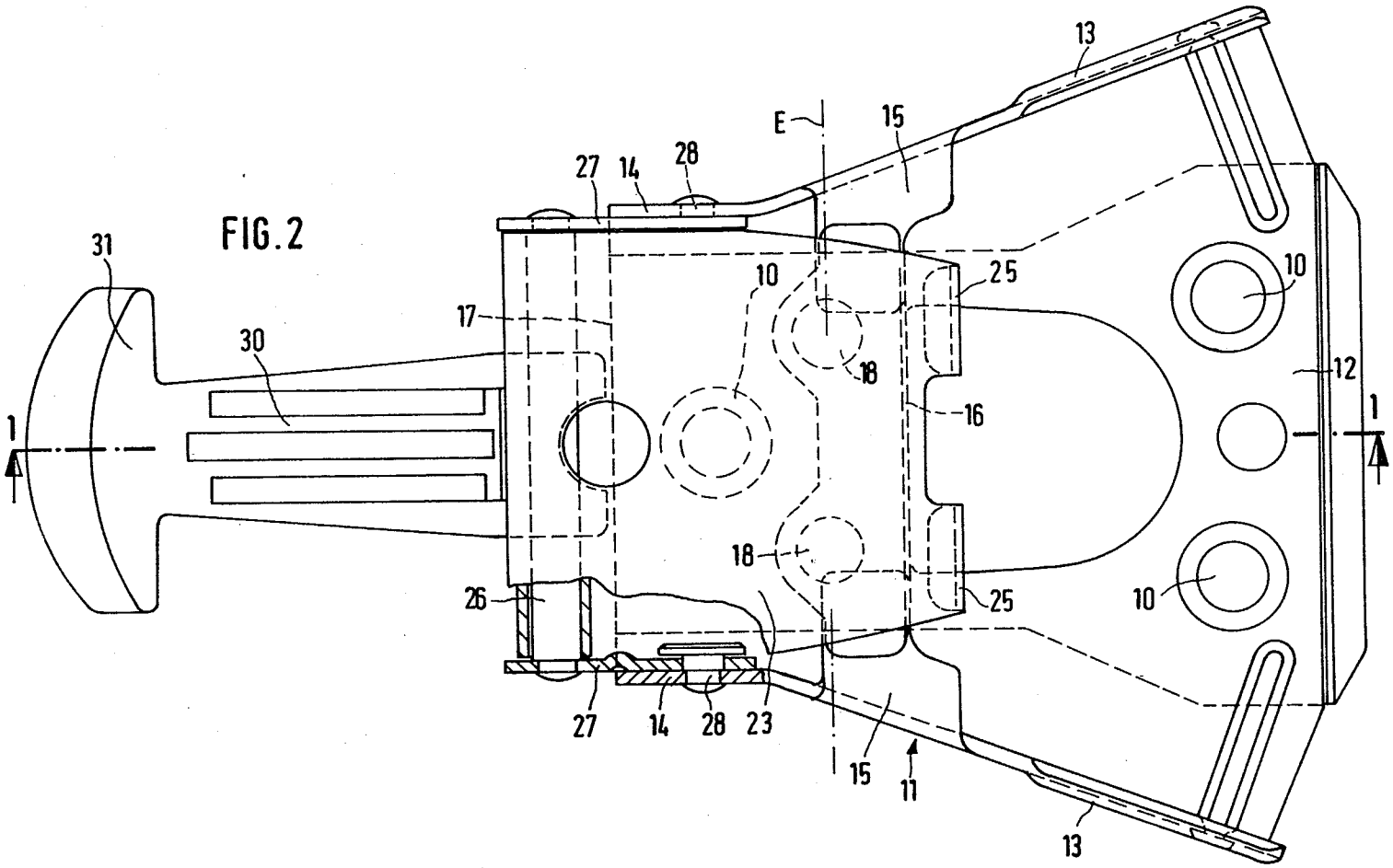
Figure 3:
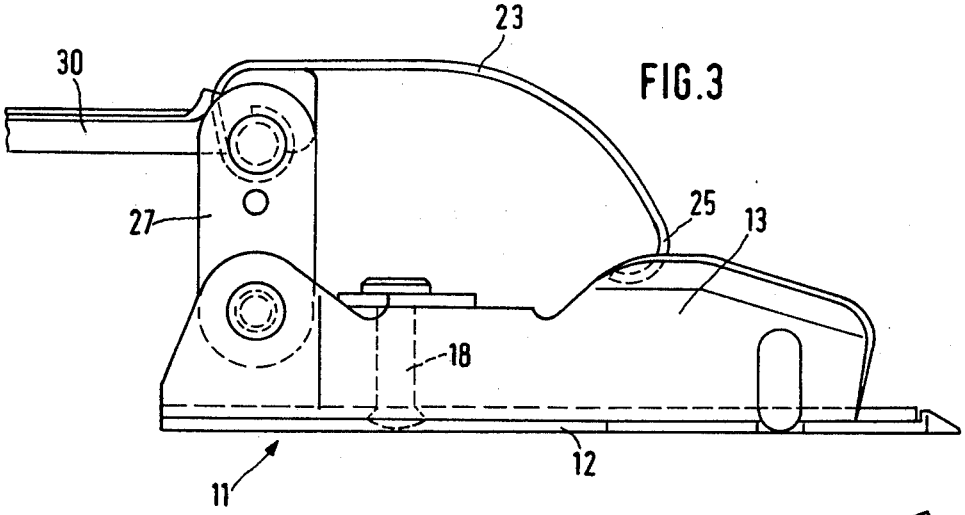
Figure 5:
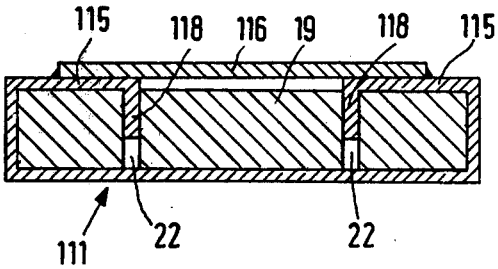
Figure 4:
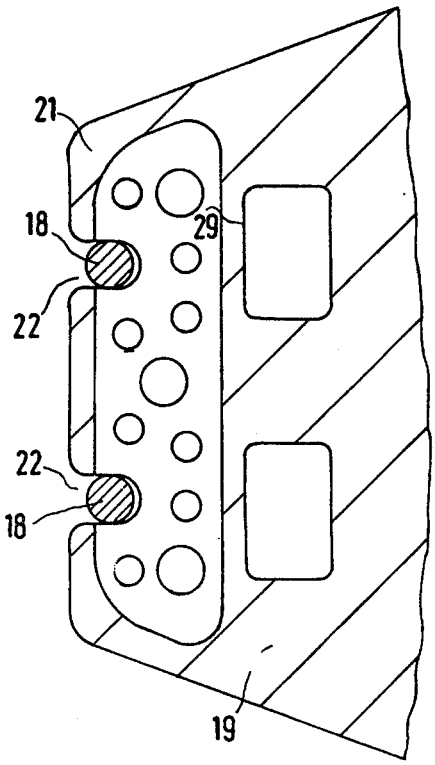

Details of the invention, in particular with respect to the aforementioned features, and further important objects of the invention can be found from the subsequent description which is made purely by way of example with reference to the accompanying drawings in which are shown;

FIG. 1 a side view of a cross country ski binding in accordance with the invention and corresponding to a section along the line 1—1 of FIG. 2, FIG. 2 a plan view of FIG. 1, FIG. 3 a side view corresponding to the view of FIG. 1, however, not shown in section and illustrating the binding in the released position, FIG. 4 a plan view of an extension of a sole of a ski shoe constructed for use with a binding in accordance with the present invention as seen in a horizontal section through the binding along the upper side of the sole extension, and FIG. 5 a schematic illustration of an alternative embodiment of the invention.

Referring now to the embodiment of FIGS. 1 to 3 there can be seen a binding 11 which is adapted to be fixedly mounted on a ski (not shown) by means of three screws 10. The binding 11 is of generally U-shaped cross section and has a base member 12 which can be wholly or partly of metal or synthetic material. Two, first and second, side walls 13 are fixedly connected with the base member 12 and serve as side cheeks for locating the toe portion of the sole of a ski shoe. As seen in plan view in FIG. 2 the side walls 13 converge in the forward direction and end in side wall portions 14 which extend parallel to one another. The first and second side walls 13 have inwardly directed first and second extensions 15 of their upper sides which are bridged by a bridge plate 16 attached for example by means of welding, to form the top wall of a recess defined between the side walls of the binding and adapted to accomodate the sole extension 21 of a ski shoe 20.

In the illustrated embodiment the base member 17 includes a base plate 12 in the form of a sheet metal steel insert which is fastened together with the base member 12 to the ski by the screws 10. It will be seen that the side walls 13, their forward extensions 14 and the inwardly directed extensions 15 are formed by folded portions of the steel base plate. Thus, in the embodiment shown the recess for accommodating the sole extension 21 is defined between a top wall comprised by the inwardly turned extensions 15 and the bridgepiece 16, a base wall defined by the base plate 17 and two side walls 13. These wall parts are fastened together to form a rigid housing with the recess defined at the interior of the housing.

In accordance with the present teaching a pair of bracing members in the form of cylindrical pins 18 are arranged within the recess, one to either side of the central longitudinal axis of the binding. The pins 18 which extend substantially at right angles to the top wall of the recess pass through the bridge plate 16 and into the base plate 17 and are preferably connected to the bridge plate and the base plate by welding. This connection can, however, also take the form of a rivetted connection in which case the pins 18 are conveniently in the form of a cylindrical sleeve secured to the bridge plate and the base plate by means of a throughgoing rivet (not shown). The binding is thus stiffened by these bracing elements 18 in particular at the transverse plane E where the base plate 17, the side walls 13, the inwardly directed extensions 15 and the bridge plate 16 cooperate to form the housing which is open at its rear end and which defines the recess for accommodating the sole extension 21. The sole extension 21 has at its forward end two longitudinal slots 22 which have the same spacing as the bracing elements 18 and which are so arranged that the bracing elements 18 engage within the slots when the sole extension is fully engaged with the binding. In this fully engaged position the sole extension is a close fit between the side, top and base walls of the recess so that the ski shoe is properly supported in the binding relative to the ski.

In a manner known per se there is provided a securing device or clamp member 23 which serves to clamp the sole extension in the recess. The securing device 23 is constructed as a resilient leaf spring member which is rolled to form a pivot eye 24 at its forward end and which carries two hook-like claws 25 at its rear end. The pivot eye 24 surrounds a pivot journal 26 and the pivot journal 26 is connected to two side disposed pivotable links 27 which are themselves pivotably connected by their rear ends to respective ones of the first and second side wall extensions 14. The rear hook-like claws 25 of the securing device 23, which could also be formed as a single hook-like end, are arranged to engage behind a correspondingly directed projection 29 of the sole extension 21 as can be seen from FIG. 1.

A hand lever 30 which can for example be formed of plastic or light metal is fixed to the forward end of the securing device 23 and is adapted by means of a T-shaped transversely enlarged handgrip at its free forward end to enable the skier to engage, or disengage, the securing device by hand or by means of a ski stick.

As can be readily seen from the side views of FIGS. 1 and 3 the securing device is constructed as a toggle linkage and can be moved from the upper released position of FIG. 3 to the lower over centre ski shoe securing position of FIG. 1 by pressing downwardly on the T-shaped grip 31. During this movement from the FIG. 3 to the FIG. 1 position the hook-like claws 25 draw the sole extension 21 forwardly into intimate engagement with the walls of the recess and the bracing members 18. The binding is thus extremely simple to use. It is only necessary for the skier to insert the ski shoe into the open rear end of the recess and to engage the securing device and depress the grip 31. As a result of this movement, and assuming appropriate dimensioning of the various parts, the longitudinal slots in the sole extension automatically come into engagement with the bracing elements 18 to reach the position shown in FIG. 4. The forward end of the sole extension 21 which is at a considerable distance from the cap of the ski shoe is now supported and braced on the one hand by the forwardly converging side walls 13 and on the other hand from below and above by the base member 12 or the base plate 17 and the top wall 15, 16. If necessary, the support in the forward direction can be supplemented or indeed replaced by contact between the bracing members 18 and the rear ends of the longitudinal slots 22. Movement of the ski shoe rearwards in the longitudinal direction of the ski is prevented by the hook-like claws 25 of the securing device 23 provided the latter is in the over centre position of FIG. 1. In this over centre position the common pivot axis of the rivets 28 which pivotably secure the rear ends of the links 27 to the respective forward wall portions 14 lies above the straight line which connects the axis of the pivot journal 26 to the point of engagement P between the hook-like claws 25 of the securing device 23 and the rearwardly directed projections 29 of the sole extension 21.

The binding can of course be released by lifting the hand lever 30 or by inserting the tip of a stick into the opening provided in the securing device 23. This procedure is thus simply the reverse of the procedure required to engage the binding.

Because the sole extension engages the bracing elements 18 by way of the longitudinal slots 22, so far as is possible without play, and because the forward end 21 of the sole extension is simultaneously drawn firmly forwardly by the securing device 23 the sole of the ski shoe has a firmly clamped seating in the aforementioned recess i.e., a shape-mating and force-locking connection is obtained between the sole extension and binding parts. This seating checks, or at least effectively reduces, both sideways tilting of the sole projection and the effects of torsional moments exerted about an axis at right angles to the ski by producing suitable countermoments.

Turning now to FIG. 5 there can be seen an alternative embodiment in which the bracing elements 118 are formed by downwardly bent parts of the inwardly directed wall extensions 115. In similar fashion to the bracing elements 18 of the previously described embodiment the bracing members 118 engage in slots 22 of the sole extension which are open at their forward ends on pushing the sole extension 19 into the recess defined by the inwardly directed side wall extensions 115, the bridge plate 116 and the side and base walls. As in the previous embodiment the bridge plate 116 which bridges the inwardly directed wall extensions 115 serves to stiffen the construction so that it is readily able to cope with the tilting moments produced during skiing. In other respects the statements made in connection with the previous embodiment of FIGS. 1 to 4 also apply to the embodiment of FIG. 5, in particular in relation to the detail of the securing device and its manner of operation.

It will appreciated by those skilled in the art that various modifications can be made to the described arrangements without departing from the scope of the present teaching. In particular it is contemplated that the bracing members 18 need not necessarily be fastened to both the base wall and the top wall defining the recess. Thus, in modifications the bracing elements can simply project downwardly from the top wall (as shown in FIG. 5) or could alternatively simply be directed upwardly from the base wall of the recess. Furthermore, it is contemplated that a base wall need not necessarily be present per se but could simply be formed by the top surface of the ski to which the binding is attached. Equally, it is contemplated that the side walls of the recess could be ommitted their function being taken over entirely by the bracing elements. Alternatively the side walls could finish short of the top wall so that they are no longer united with the top wall to form a housing defining the required recess. It is, however, preferred that the recess be enclosed on all sides in similar fashion to the illustrated embodiments. It should be noted that although the preferred number of bracing elements is two it is also possible to conceive of embodiments using only one such bracing element.

Finally it should be noted that various modifications are possible to the design of the securing device. In particular the pair of links 27 could readily be replaced by a single link.

We claim:

1. A cross country ski binding for securing a ski shoe by a forwardly directed extension of its sole to a ski, the binding comprising a recess open at its rear end and defined by at least first and second side walls and a top wall for supporting a said sole extension introduced through the rear end of the recess, there being at least one bracing member arranged within the recess and extending substantially at right angles to said top wall, said bracing member being adapted in operation to engage in a corresponding longitudinally extending, slot in said sole extension, which slot is open at its forward end, and a securing device engageable with a ski shoe engaged in the binding to prevent it being withdrawn rearwardly from the binding, said securing device being operative to draw the sole extension forwardly into engagement with forwardly disposed abutment means defined by at least one of said at least one bracing member and the first and second side walls, thereby enabling a shape-mating and force-locking connection to be achieved between said binding and sole extension and in which said at least one bracing member is of circular horizontal cross-section.

2. A cross country ski binding according to claim 1 and in which said first and second side walls and said top wall are arranged together to form a housing with the interior of said housing defining said recess.

3. A cross country ski binding according to claim 1 and in which the binding includes a base wall which cooperates with the first and second side walls and the top wall to define said recess.

4. A cross country ski binding according to claim 2 and in which the binding includes a base wall which cooperates with the first and second side walls and the top wall to form said housing.

5. A cross country ski binding according to claim 3 and in which said base wall comprises part of a base plate for fixing the binding to a ski.

6. A cross country ski binding according to claim 4 and in which said base wall comprises part of a base plate for fixing the binding to a ski.

7. A cross country ski binding according to claim 1 and in which the securing device is engageable behind a lip formed on the upper surface of said sole extension.

8. A cross country ski binding according to claim 7 and in which first and second bracing members are respectively disposed one to each side of the central longitudinal axis of the binding and are adapted to engage in operation in respective first and second slots in a said sole extension.

9. A cross country ski binding according to claim 3 and in which said at least one bracing member comprises an upwardly directed projection from said base wall.

10. A cross country ski binding according to claim 1 and in which said securing device is journalled on the ski binding in front of said abutment means for movement in the longitudinal direction of the ski binding, is of hook-like construction and extends beyond and over said at least one bracing member to engage with a correspondingly constructed means of said sole extension to engage and urge the same into the forward direction.

11. A cross country ski binding according to claim 10 and in which the securing device has two hook-like claws at its rear end disposed respectively one to either side of the longitudinal axis of the binding.

12. A cross country ski binding according to claim 10 and in which the securing device is constructed as a toggle linkage to be movable via link means connected to said binding between an upper released and a lower over center ski shoe securing position.

13. A cross country ski binding according to claim 12 and in which said securing device is of resilient construction.

14. A cross country ski binding according to claim 10 and in which said securing device has a transversely enlarged handgrip at its free forward end.

15. A cross country ski binding for securing a ski shoe by a forwardly directed extension of its sole to a ski, the binding comprising a recess open at its rear end and defined by at least first and second side walls and a top wall for supporting a said sole extension introduced through the rear end of the recess, there being at least one bracing member arranged within the recess and extending substantially at right angles to said top wall, said bracing member being adapted in operation to engage in a corresponding longitudinally extending, slot in said sole extension, which slot is open at its forward end, and a securing device engageable with a ski shoe engaged in the binding to prevent it being withdrawn rearwardly from the binding, said securing device being operative to draw the sole extension forwardly into the engagement with forwardly disposed abutment means defined by at least one of said at least one bracing member and the first and second side walls, thereby enabling a shape-mating and force-locking connection to be achieved between said binding and sole extension and in which said at least one bracing member comprises a downwardly directed projection from said top wall.

16. A cross country ski binding according to claim 15 and in which said at least one bracing member is of elongate cross-section in the longitudinal direction of the binding.

17. A cross country ski binding for securing a ski shoe by a forwardly directed extension of its sole to a ski, the binding comprising a recess open at its rear end and defined by at least first and second side walls and a top wall for supporting a said sole extension introduced through the rear end of the recess, there being at least one bracing member arranged within the recess and extending substantially at right angles to said top wall, said bracing member being adapted in operation to engage in a corresponding longitudinally extending, slot in said sole extension, which slot is open at its forward end, and a securing device engageable with a ski shoe engaged in the binding to prevent it being withdrawn rearwardly from the binding, and in which the binding includes a base plate and has first and second bracing members which connect said base plate to respective inwardly directed first and second extensions of said first and second side walls with said first and second extensions defining respective first and second parts of said top wall.

18. A cross country ski binding according to claim 17 and in which said top wall connects together at least the forward portions of said first and second side walls.

19. A cross country ski binding according to claim 18 and in which, at least over a portion of their lengths, the side walls converge towards one another in a forward direction.

20. A cross country ski binding for securing a ski shoe by a forwardly directed extension of its sole to a ski, the binding comprising a recess open at its rear end and defined by at least first and second side walls and a top wall for supporting a side sole extension introduced through the rear end of the recess, there being at least one bracing member arranged within the recess and extending substantially at right angles to said top wall, said bracing member being adapted in operation to engage in a corresponding longitudinally extending, slot in said sole extension, which slot is open at its forward end, and a securing device engageable with a ski shoe engaged in the binding to prevent it being withdrawn rearwardly from the binding, and in which the binding further includes a base wall member cooperating with the first and second side walls and the top wall to define said recess and the bracing member is fixed to said top and base walls.

21. A cross country ski binding according to claim 20 and in which said at least one bracing member is of circular horizontal cross-section.

22. A cross country ski binding for securing a ski shoe by a forwardly directed extension of its sole to a ski, the binding comprising a recess open at its rear end and defined by at least first and second side walls and a topwall for supporting a said sole extension introduced through the rear end of the recess, at least one bracing means, extending perpendicularly with respect to said top wall, for engaging in a corresponding forwardly open slot in said sole extension and for at least effectively reducing sideways tilting of the sole extension and the effects of torsional movements exerted about an axis at right angles to the ski, and a securing device engageable with the ski shoe for engaging said bracing means within said slot and preventing rearward withdrawal of said sole extension from the binding wherein said bracing means comprises a projection extending downwardly from said top wall.

* * * * *